US005130757A

United States Patent [19]

Ito

[11] Patent Number: 5,130,757

[45] Date of Patent: Jul. 14, 1992

[54] ELECTROPHOTOGRAPHIC COPYING MACHINE HAVING AN AUTOMATIC PAPER SELECTING FUNCTION

[75] Inventor: Masazumi Ito, Osaka, Japan

[73] Assignee: Minolta Camera Kabushiki Kaisha, Osaka, Japan

[21] Appl. No.: 614,973

[22] Filed: Nov. 19, 1990

Related U.S. Application Data

[63] Continuation of Ser. No. 241,198, Sep. 7, 1988, abandoned.

[30] Foreign Application Priority Data

Sep. 9, 1987 [JP] Japan ..... 62-227299

[51] Int. Cl.[5] ..... G03G 21/00

[52] U.S. Cl. ..... 355/311; 271/9; 355/208; 355/313

[58] Field of Search ..... 271/9; 355/311, 326, 355/327, 313, 208, 209, 205, 206

[56] References Cited

U.S. PATENT DOCUMENTS

| | | | |
|---|---|---|---|
| 4,440,487 | 4/1984 | Miura | 355/311 |
| 4,585,332 | 4/1986 | Shenoy | 355/243 |
| 4,647,188 | 3/1987 | Komiya et al. | 355/243 |
| 4,669,858 | 6/1987 | Ito et al. | 355/243 |
| 4,727,398 | 2/1988 | Honjo et al. | 271/3.1 X |
| 4,740,810 | 4/1988 | Ito | 355/56 |
| 4,763,889 | 8/1988 | Dei et al. | 271/9 |
| 4,796,056 | 1/1989 | Ito | 355/56 X |
| 4,804,997 | 2/1989 | Mizude et al. | 271/9 X |

FOREIGN PATENT DOCUMENTS 60-212778 10/1985 Japan .

*Primary Examiner*—A. T. Grimley
*Assistant Examiner*—Robert Beatty
*Attorney, Agent, or Firm*—Burns, Doane, Swecker & Mathis

[57] ABSTRACT

An electrophotographic copying machine includes photosensitive means, image forming means for forming an image of an original on the photosensitive means and transferring the image onto copy paper, a plurality of paper feed means each containing a plural number of sheets of copy paper for feeding the sheets one by one to the image forming means, original detecting means for detecting a size of the original to be copied, copy paper detection means for detecting a size and a type of the copy paper contained in each paper feed means, automatic selection means for automatically selecting the paper feed means containing copy paper of the same size as that of the original, and forbidding means for forbidding operation of the automatic selection means and the original detecting means when copy paper of a predetermined type is not contained in any of the paper feed means.

17 Claims, 17 Drawing Sheets

ELECTROPHOTOGRAPHIC COPYING MACHINE HAVING AN AUTOMATIC PAPER SELECTING FUNCTION

This application is a continuation of application Ser. No. 07/241,198, filed Sep. 7, 1988, now abandoned.

CROSS-REFERENCE TO RELATED, COPENDING APPLICATION

A related, copending application of particular interest to the present application is the U.S. patent application Ser. No. 022,935, now U.S. Pat. No. 4,796,056, entitled "Electrophotographic Copying Machine Having Automatic Paper Selecting Function" filed Mar. 10, 1986 and assigned to the same assignee of the present application.

BACKGROUND OF THE INVENTION

1. Field of the Invention

This invention relates to an electrophotographic copying machine having an automatic paper selecting function and particularly to an electrophotographic copying machine having an improved efficiency of operation in an automatic paper selection mode.

2. Description of the Prior Art

In the prior art, there is known an electrophotographic copying machine having an automatic paper selection mode, which comprises a plurality of paper feed portions for containing paper sheets of different sizes and automatically selects a paper feed portion containing paper sheets of a size corresponding to a size of a document to be copied, thereby to perform copy operation using the paper in the selected paper feed portion.

In such an electrophotographic copying machine, if the automatic paper selection mode is selected and a print key is pressed, the size of the document is detected and then a paper feed portion containing paper suited for the detected size of the document is automatically selected, whereby copy operation is performed.

Generally, when a copy operation is to be carried out in the automatic paper selection mode, designated by the operator, the operator expects that the copy is made on plain paper, e.g., white paper. However, in a conventional copying machine, the copy operation in the automatic paper selection mode is permitted irrespective of the type of paper contained in a paper feed portion and accordingly it sometime happens that the copy is made on paper of a type different from that desired by the operator, e.g., color paper.

SUMMARY OF THE INVENTION

In view of the above described prior art, it is an object of the present invention to provide an electrophotographic copying machine having an improved efficiency in copy operation in an automatic paper selection mode.

According to an aspect of the present invention, an electrophotographic copying machine comprises: a photosensitive member; an image forming device for forming an image of an original on the photosensitive member and transferring the image on copy paper; paper feeders each containing sheets of copy paper and feeding the sheets of copy paper one by one to the image forming device; an original detector for detecting a size of the original to be copied; a paper detector for detecting a size and a type of copy paper contained in each paper feeder; an automatic selector for selecting a paper feeder containing copy paper of the same size as that of the original; and a forbidding device for forbidding operation of the automatic selector when copy paper of a specified type is not contained in any of the paper feeders.

According to another aspect of the present invention, an electrophotographic copying machine comprises: a photosensitive member; an image forming device for forming an image of an original on the photosensitive member and transferring the image on copy paper; paper feeders each containing sheets of copy paper and feeding the sheets of copy paper one by one to the image forming device; an original detector for detecting a size of the original to be copied; a paper detector for detecting a size and a type of copy paper contained in each paper feeder; a manual selector for manually selecting one of the paper feeders; an automatic selector for automatically selecting a paper feeder containing copy paper of the same size as that of the original in an automatic mode; a mode selector for selecting the automatic mode; and a cancel device for cancelling the selection of the automatic mode when copy paper of a specified type is not contained in any of the paper feeders.

These objects and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention will be described in the below indicated order with reference to the attached drawings.

a. Construction of a Copying Machine b. Operation Panel c. Construction of a Control Portion of the Copying Machine d. Operation of a Main body of the Copying Machine (d-1) Main Routine (d-2) Paper Selection (d-3) Empty Display Control (d-4) Copy Operation (d-5) Automatic Paper Selection e. Operation of an Automatic Document Feeder Processing in an automatic paper selection mode in which a characteristic feature of the present invention resides will be specifically described in (d-3), the first half of (d-4) and (d-5).

(a) Construction of a Copying Machine

Figure 1:
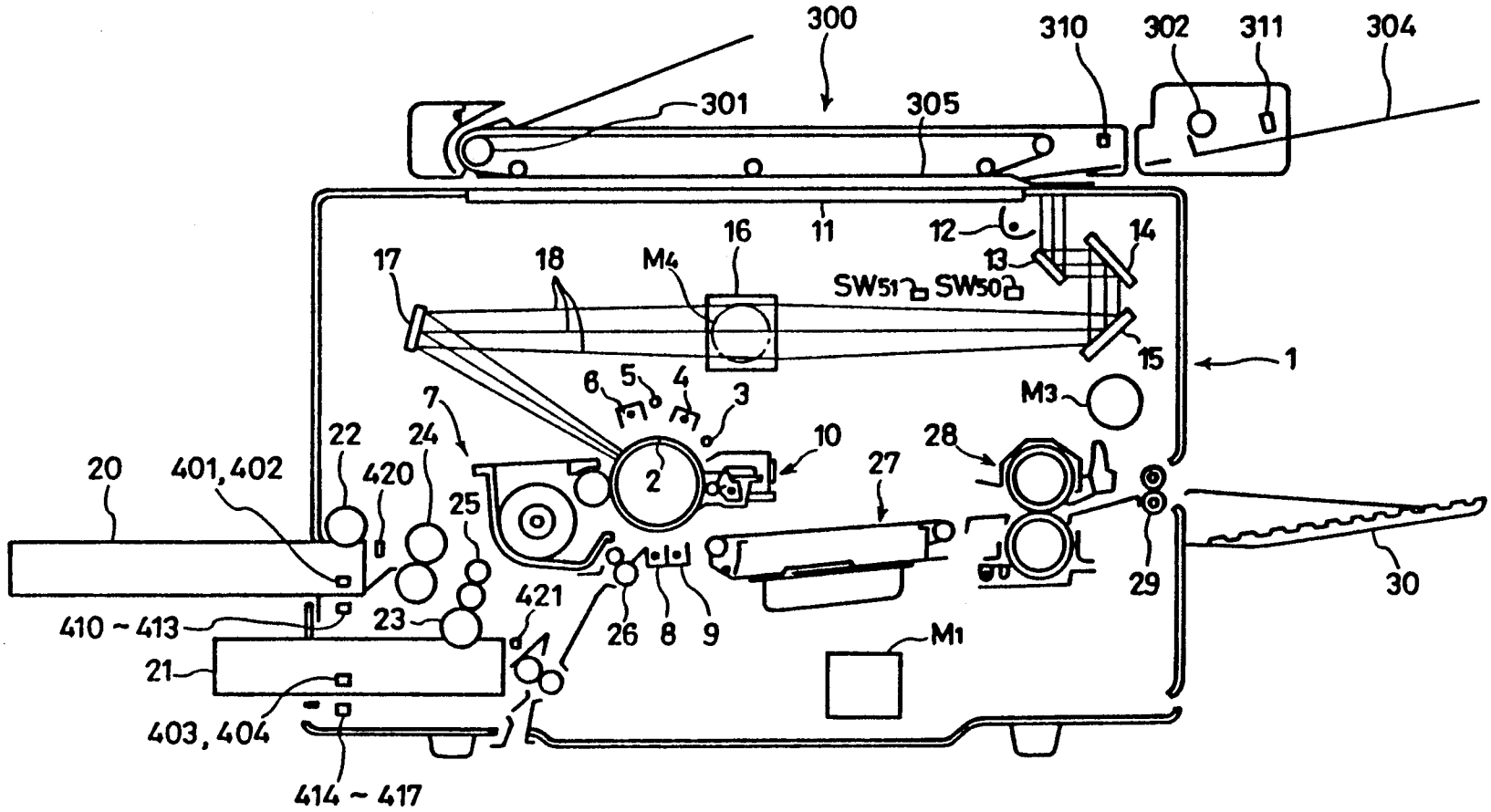
FIG. 1 is a schematic sectional view of an electrophotographic copying machine according to an embodiment of the present invention.

FIG. 1 is a schematic sectional view of an electrophotographic copying machine of an embodiment of the present invention.

Referring first to FIG. 1, construction of the electrophotographic copying machine of this embodiment will be described.

A copying mechanism of a main body 1 of the electrophotographic copying machine shown in FIG. 1 is the same as that of a conventional electrophotographic copying machine A photosensitive drum 2 rotatable counterclockwise is provided in a central portion of the main body 1 and, around this photosensitive drum 2, there are provided a main eraser lamp 3, an auxiliary charger 4, an auxiliary eraser lamp 5, a main charger 6, a development device 7, a transfer charger 8, a transfer paper separation charger 9, and a cleaner 10 of a blade type. The photosensitive drum 2 has a surface on which a photosensitive material such as selenium is provided. For each copy operation, this photosensitive drum 2 receives light from the eraser lamps 3 and 5 and is charged by the chargers 4 and 6 and then it is subjected to a imaging exposure from an optical system to be described below. A motor M1 drives the photosensitive drum 2 and other related components.

The optical system is provided under a document table 11 of glass so as to scan an image of a document. The optical system comprises a light source 12, a first mirror 13, a second mirror 14, a third mirror 15, a projection lens 16 and a fourth mirror 17. The image of the document reaches the photosensitive drum 2 through the respective mirrors 13, 14, 15 and 17 as shown by the lines 18. A position switch SW50 is provided for detection as to whether the optical system is located at a prescribed position at the time of scanning. A copying magnification is set by moving the projection lens 16 along the direction of the optical axis by means of a motor M4. A motor M3 drives the optical system. If the magnification is n, the light source 12 and the first mirror 13 are moved to the left at a speed v/n by the motor M3 corresponding to rotation of the photosensitive drum 2 at a rotation speed v (which is constant irrespective of whether an equal-scale magnification or a variable magnification is selected) and, at the same time the second mirror 14 and the third mirror 15 are moved to the left at a speed v/2n. As a result of those movements, exposure of the image is applied to the photosensitive drum 2 through the fourth mirror 17 in a slit manner.

Automatic paper feed cassettes 20 and 21 are provided in an upper feed opening and a lower feed opening, respectively, on the left side of the main body 1 of the copying machine. Paper in the automatic paper feed cassette 20 or that in the automatic paper feed cassette 21 is selectively fed into the main body 1 by means of a paper feed roller 22 or 23 and passes through transport rollers 24 and 25 to reach timing rollers 26 in a pressed state, where it is temporarily stopped.

At the time of transfer operation, the paper fed by the timing rollers 26 is closely attached to the photosensitive drum 2 in a transfer portion and a toner image is transferred onto the paper by corona discharge of the transfer charger 8. Then, the paper is separated from the photosensitive drum 2 by corona discharge of the separation charger 9 as well as by the elasticity of the paper itself. Subsequently, the paper is drawn onto a transport belt 27 comprising air suction means, not shown, so that it is moved rightward by clockwise rotation of this belt 27. When the paper passes through a fixing device 28, the toner image is subjected to thermal fusing. Then, the paper passes through discharge rollers 29 so as to be discharged onto a tray 30 outside the main body 1.

Paper type (color) detection switches 401 and 402, and paper type (color) detection switches 403 and 404 are read switches for detecting a type (color) of paper in the cassette 20 and that in the cassette 21, respectively. Paper size detection switches 410 to 413 and 414 to 417 are microswitches provided in the upper and lower feed openings. Those detection switches 410 to 413 and 414 to 417 detect sizes of paper in the cassettes 20 and 21, respectively, and those switches determine whether paper is set lengthwise, namely in a direction in which its longer sides are parallel to the paper feeding direction, or widthwise, namely in a direction in which its longer sides are perpendicular to the paper feeding direction. Sizes of paper which can be copied, namely, sizes of paper which can be set in the respective paper feed portions are for example A3, A4, A5, B4 and B5 sizes and as for the A4 and B5 sizes, lengthwise and widthwise setting directions can be selected. Switches 420 and 421 detect attachment or detachment of the cassettes 20 and 21, respectively, to or from the main body 1 and by this detection, existence or nonexistence of paper in the respective paper feed openings can be indirectly detected. A size and a setting direction of paper are detected by four-bit codes according to combination of on/off states of the switches 410 to 413 and 414 to 417 so as to be stored in a RAM contained in the microprocessor 201 of a control circuit (to be described afterwards in connection with FIG. 5). An example of a code table based on combination of the switches 410 to 413 is shown in the following table. In this table, "0" represents an on state of a switch and "1" represents an off state of a switch. If all of the switches are turned off, it is determined that the cassette 20 is not attached to the paper feed portion, namely, that paper does not exist in the paper feed portion.

TABLE 1

| Decimal Code | Binary Code SW413 | SW412 | SW411 | SW410 | Paper Size |
|---|---|---|---|---|---|
| 0 | 0 | 0 | 0 | 0 | |
| 1 | 0 | 0 | 0 | 1 | |
| 2 | 0 | 0 | 1 | 0 | |
| 3 | 0 | 0 | 1 | 1 | |
| 4 | 0 | 1 | 0 | 0 | B5 lengthwise |
| 5 | 0 | 1 | 0 | 1 | A4 lengthwise |
| 6 | 0 | 1 | 1 | 0 | B4 lengthwise |
| 7 | 0 | 1 | 1 | 1 | A3 lengthwise |
| 8 | 1 | 0 | 0 | 0 | |
| 9 | 1 | 0 | 0 | 1 | |
| 10 | 1 | 0 | 1 | 0 | B5 widthwise |
| 11 | 1 | 0 | 1 | 1 | A4 widthwise |
| 12 | 1 | 1 | 0 | 0 | |
| 13 | 1 | 1 | 0 | 1 | |
| 14 | 1 | 1 | 1 | 0 | |
| 15 | 1 | 1 | 1 | 1 | no suitable cassette |

Figure 2A:
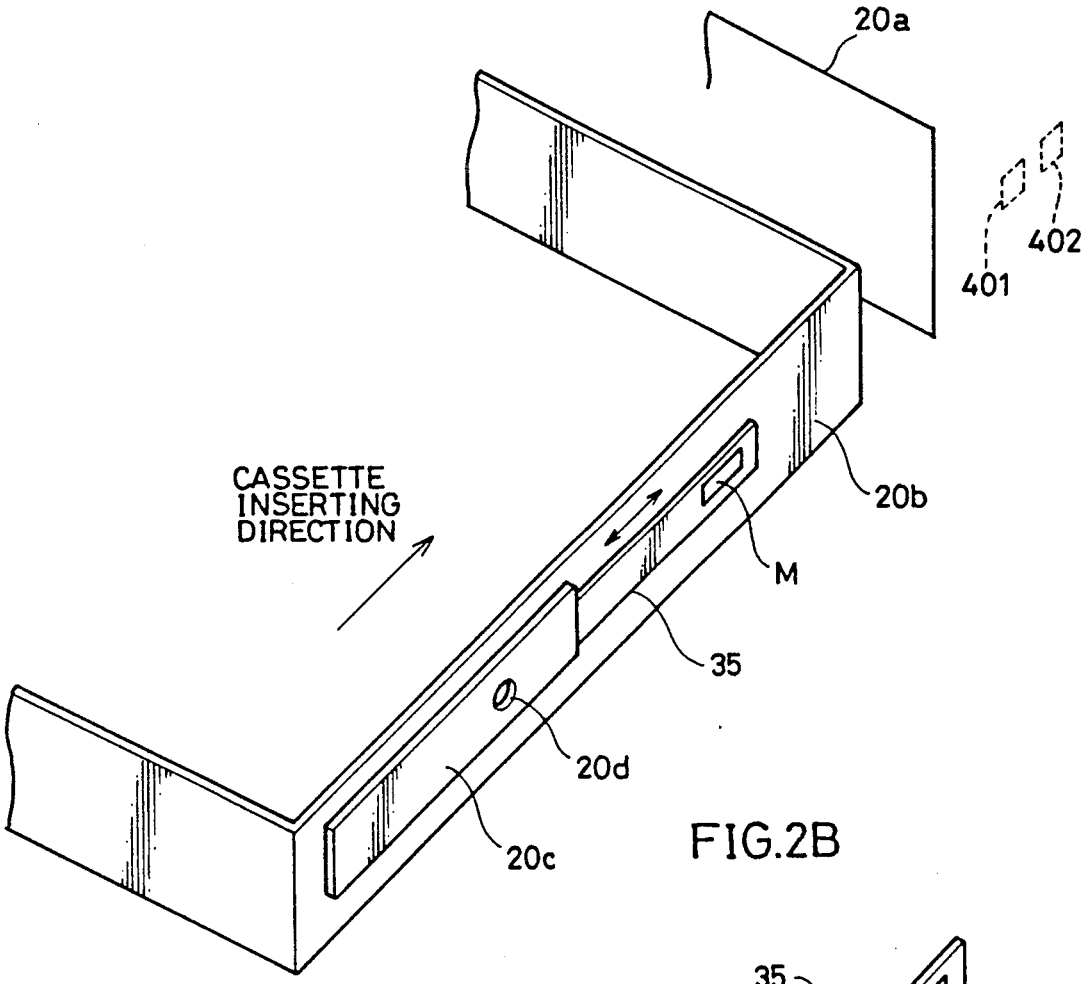
FIGS. 2A and 2B are perspective views showing a mechanism for selecting a color of paper set in a cassette.
Figure 2B:
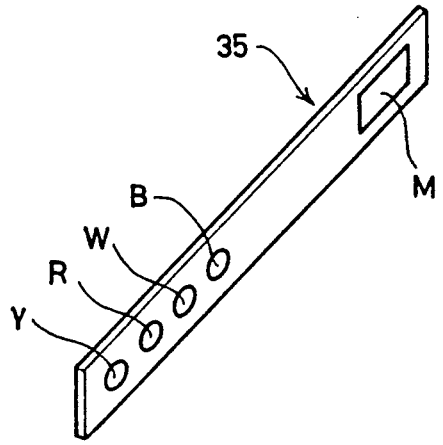

Referring to FIGS. 2A and 2B, detection by the paper type (color) detection switches 401 and 402 shown in FIG. 1 as to a type (color) of paper set in the cassette 20 will be described. As shown in FIG. 2A, an indication plate 35 having one end provided with a magnet M is provided on a side face 20*b* of the cassette 20. An opening 20*a* in the copying machine receives the cassette 20. On the other end portion of the indication plate 35, four colors, i.e. black B, white W, red R and yellow Y are indicated as shown in FIG. 2B. This color indicating portion is inserted in a space formed between the side face 20*b* and a guide plate 20*c* so that the indication plate 35 is movable in this space along a cassette inserting direction. The position of the magnet M provided on the indication plate 35 is changed for each color and a color signal is obtained by combination of on/off states of the switches 401 and 402. The guide plate 20*c* has a window 20*d* and a color selected by moving the indication plate 35 can be visually confirmed through the window 20*d*.

Referring again to FIG. 1, there is shown a document feeding unit 300 of an automatic document feeder placed on the main body 1 of the copying machine. In this document feeding unit 300, a sensor 310 determines whether a document is fed or not and a sensor 311 determines whether a document exists on a document tray 304.

A motor 301 rotates a document transport belt 305 of the document feeding unit 300 and a motor 302 delivers a document from the document tray 304.

In order to start a copying operation in an automatic document feeding mode, a start key of an operation panel to be described below in (b) is pressed. First of all, an automatic document feeding mechanism is operated. The document feeding unit 300 feeds a document on the document tray 304 so that the document is moved to a prescribed position on the document table 11 of glass on the upper surface of the main body 1 by means of the belt 305. During the movement, the sensor 310 determines a size of the document.

When the document reaches the prescribed position and the belt stops, the main body 1 of the copying machine starts operation. This operation mode is set when the automatic document feeder is connected to the main body 1 and a document is placed on the document tray 304. The document feeding unit 300 can be opened like a document cover. When the document feeding unit 300 is opened and a document is manually placed on the document table, the automatic document feeding mode is cancelled and copy operation in a standard mode is performed. When the automatic document feeding mode is cancelled, a document size cannot be detected and if an automatic paper selection mode is selected, this mode is also cancelled.

(b) Operation Panel

Figure 3:
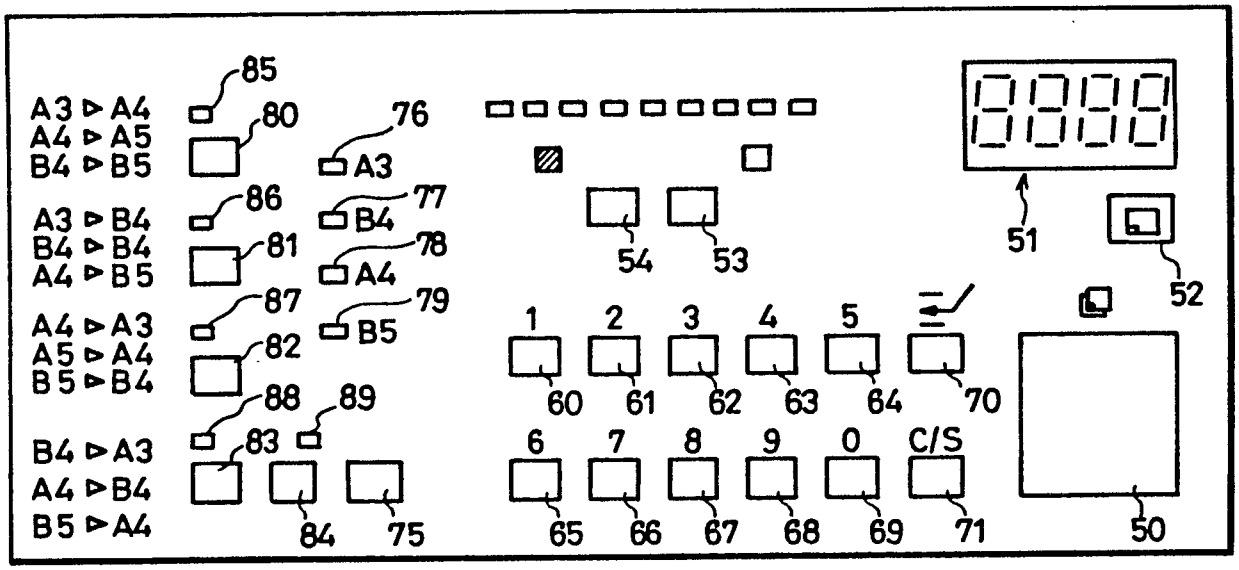
FIG. 3 is a plan view of an operation panel of the copying machine.

FIG. 3 shows an operation panel of the copying machine shown in FIG. 1. This operation panel comprises keys and display elements denoted by the following reference numerals.

50: print start key for starting copy operation

51: numerical display of light emitting diode (LED) for displaying the number of copies

52: empty display

53: exposure degree increment key

54: exposure degree decrement key

60 to 69: ten keys for setting the number of copies and other data

70: interruption key for interrupting copy operation and allowing another copy operation

71: key serving as a stop key for stopping copy operation in a multiple mode and as a clear key for clearing stored numerical data

75: paper selection key

76 to 79 A3, B4, A4 and B5 selection displays

80: scale-down selection key from A3 to A4

81: scale-down selection key from A3 to B4

82: scale-up selection key from A4 to A3

83: scale-up selection key from B4 to A3

84: equal scale magnification selection key

85 to 88: selection displays of the selection keys 80 to 83

89: equal magnification selection display

Figure 4:
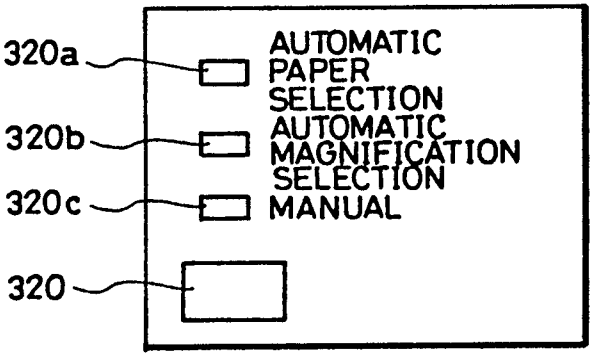
FIG. 4 is a plan view of an operation panel of an automatic document feeder.

FIG. 4 shows an automatic document feeding operation panel provided on the document feeding unit 300. This operation panel comprises a selection key 320. LED display elements 320*a*, 320*b* and 320*c* indicate selection of an automatic paper selection mode, an automatic magnification selection mode and a manual mode, respectively. Each time the selection key 320 is pressed, a mode to be selected is changed and a display element which emits light is changed.

(c) Construction of a Control Portion of the Copying Machine

Figure 5:
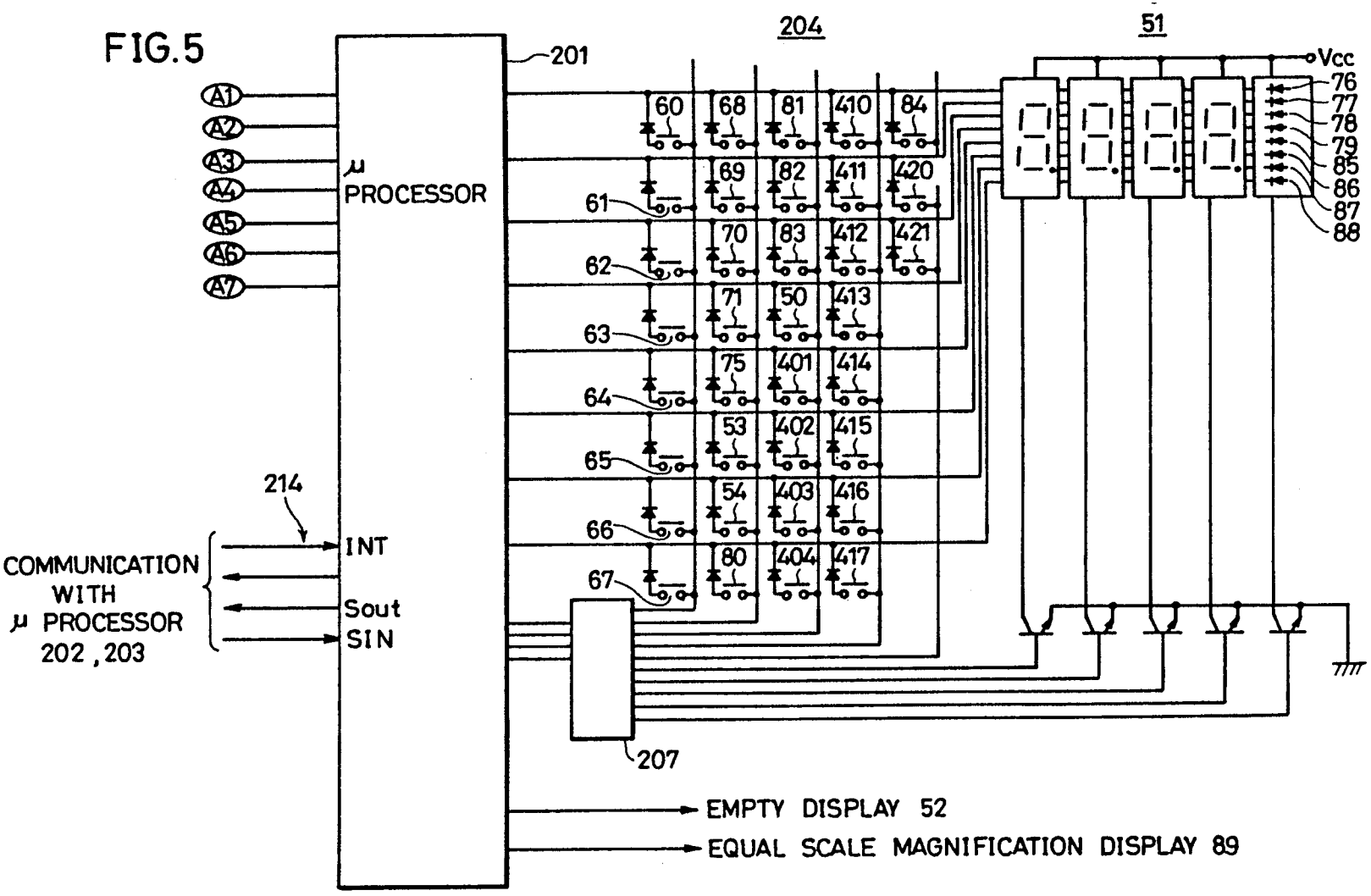
FIG. 5 is a circuit diagram showing an input and output relation with respect to a microprocessor 201 for controlling a main body of the copying apparatus.

FIG. 5 is a circuit diagram showing an input and output relation with respect to the microprocessor 201 for controlling the main body 1 of the copying machine. Input terminals of the microprocessors 201 receive various signals as shown (such as signals for a main motor (A1), a development motor (A2), a timing roller clutch (A3), an upper paper feed clutch (A4), a lower paper feed clutch (A5), a charger (A6), a transfer charger (A7) etc.) while input terminals are connected with a switch matrix 204 comprising various sensors and keys (denoted by the reference numerals 50, 52, 53, 60 to 71, 80 to 84, 401 to 404, 410 to 417, 420 and 421). Output terminals of the microprocessor 201 are connected with the four-digit numerical display 51 and the LED display matrix (denoted by the reference numerals 76 to 79 and 85 to 88) through a decoder 207. The empty display 52 and the equal scale magnification display 89 are also connected to the output terminals. A bus 214 serves as communication lines connected to other microprocessors 202 and 203 to be described afterwards.

Figure 6:
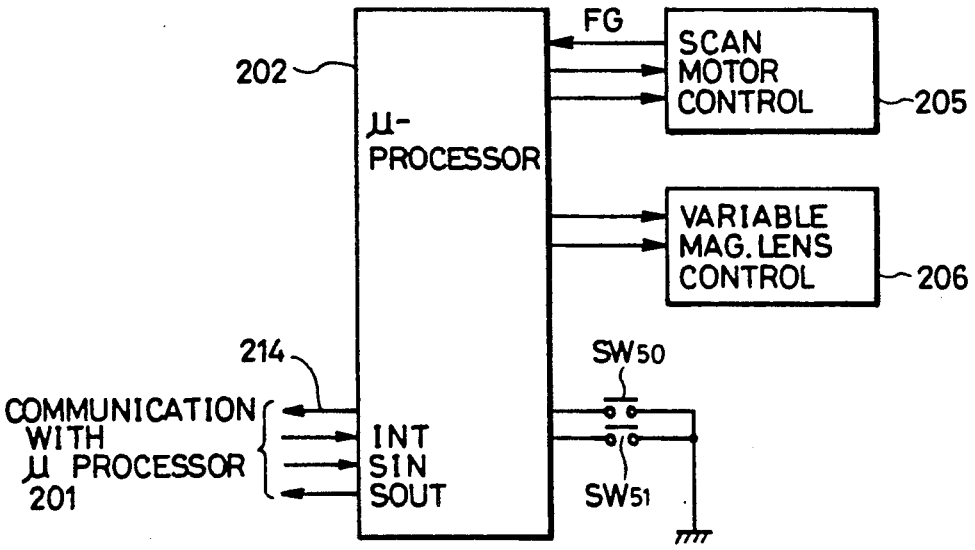
FIG. 6 is a circuit diagram showing an input and output relation with respect to a microprocessor 202 for controlling an optical system of the copying machine.

FIG. 6 is a circuit diagram showing an input and output relation with respect to the microprocessor 202 for controlling the optical system of the copying machine. Input/output ports of the microprocessor 202 are connected with a scanning motor control circuit 205 for controlling the scanning motor M3 and a variable magnification lens control circuit 206 for controlling the motor M4 for moving the projection lens 16. The input-/output ports receive a signal from the prescribed position detection switch SW50 of the optical system and also receive a signal from the switch SW51 for generating a timing signal to rotate the timing rollers 26 at the time of copy operation with an equal scale magnification. The microprocessor 202 communicates with the microprocessor 201 through the bus 214 as described previously.

Figure 7:
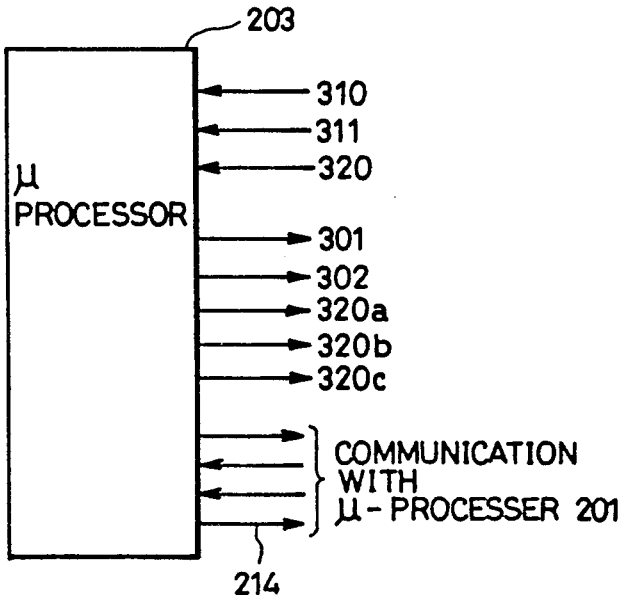
FIG. 7 is a circuit diagram showing an input and output relation with respect to a microprocessor 203 for controlling the automatic document feeder.

FIG. 7 is a circuit diagram showing an input and output relation with respect to the microprocessor 203 for controlling the document feeding unit 300. The microprocessor 203 provides signals to the transport belt motor 301 and the paper feed motor 302 and receives signals from the document feed sensor 310 and the document detection sensor 311. The microprocessor 203 is connected with the selection key 320 and the display elements 320*a* to 320*c*. As described previously, the microprocessor 203 communicates with the microprocessor 201 through the bus 214.

(d) Operation of the Main Body of the Copying Machine

An outline of a program of the microprocessor 201 for controlling the main body 1 of the copying machine will be described.

In the following description, the terms "ON edge" and "OFF edge" are used and those terms are defined as below.

The "ON edge" means a change from OFF state to ON state of the switches, sensors, signals and the like.

The "OFF edge" means a change from ON state to OFF state of the switches, sensors, signals and the like.

(d-1) Main Routine

Figure 8:
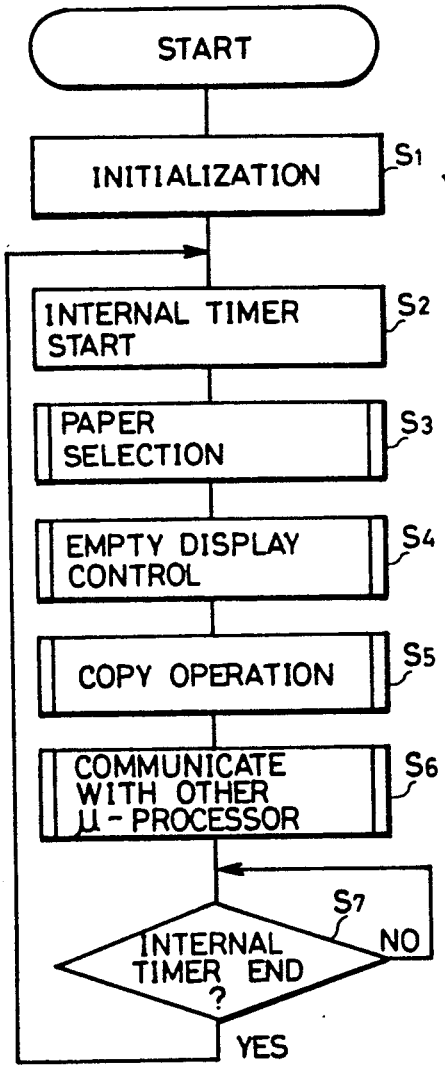
FIG. 8 is a flow chart of a main routine of a program for controlling the main body of the copying machine.

FIG. 8 shows an outline flow chart of the microprocessor 201. When the microprocessor 201 is reset to start the program, initialization is performed. More specifically, the microprocessor 201 is initialized to clear the RAM and to set the registers to initial values, and the copying machine is set to an initial mode (in the step S1).

Then, an internal timer contained in the microprocessor 201 and having a value set by the initialization starts measurement (in the step S2). Subsequently, various processing operations such as paper selection (in the step S3), empty display control (in the step S4) and copy operation (in the step S5) are successively performed. Then, data is communicated with the microprocessors 202 and 203 (in the step S6).

When all the procedures of the subroutines are completed, the microprocessor 201 waits for an end of the measurement of the initially set internal timer (in the step S7) to bring one routine to an end. Then, the program returns to the step S2. Using the time period of one routine as a unit length, various timers in the subroutines perform measurement. (A count value of each timer corresponds to the number of occurrences of one routine, by which an end of measurement of each timer is determined).

(d-2) Paper Selection

Figure 9:
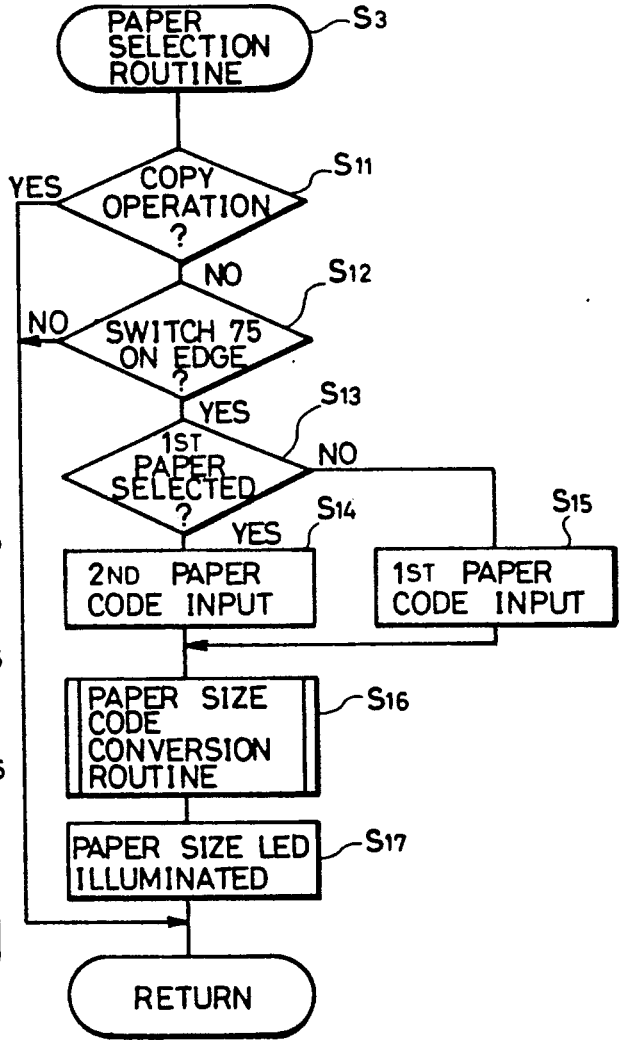
FIG. 9 is a flow chart of a subroutine of paper selection.

FIG. 9 is a flow chart of the paper selection routine (in the step S3).

When copy operation is being done (in the step S11), control returns to the main routine. If the paper selection switch 75 is turned on when the first paper is selected at present (in the steps S12 and S13), the second paper is newly selected (in the step S14). If the switch 75 is turned on when the second paper is selected at present (in the steps S12 and S13), the first paper is newly selected (in the step S15). Thus, a paper size code of the paper is inputted. Then, a paper size code conversion routine (to be described in detail below) is called (in the step S16 so that one of the LED display elements 76 to 79 corresponding to the set paper size is illuminated (in the step S17).

Figure 10:
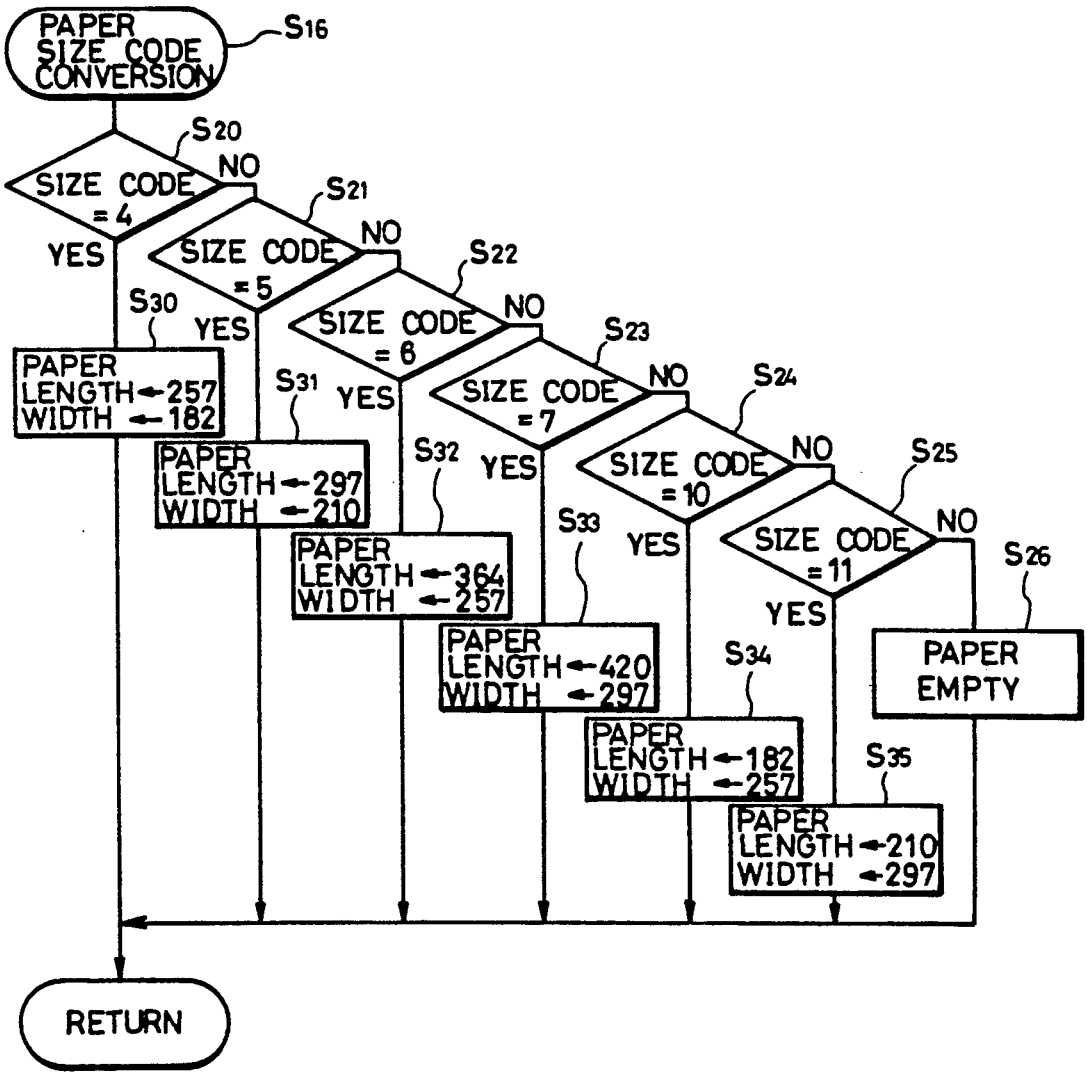
FIG. 10 is a flow chart of a subroutine for conversion of a paper size code.

FIG. 10 shows the paper size code conversion routine. The paper sizes are coded as indicated above in Table 1. If the inputted paper size code is "4" (in the step S20), this means that paper of the B5 size is set lengthwise, namely, the paper is set with its longer sides being parallel to the feeding direction, and accordingly a paper length of 257 mm and a paper width of 182 mm are stored in memory (in the step S30).

Similarly, if a paper size code is "5" (in the step S21), it is determined that paper of the A4 size is set lengthwise; if it is "6" (in the step S22), it is determined that paper of the B4 size is set lengthwise; if it is "7" (in the step S23), it is determined that paper of the A3 size is set lengthwise; if it is "10" (in the step S24), it is determined that paper of the B5 size is set widthwise, namely, the paper is set with its longer sides being perpendicular to the feeding direction and if it is "11" (in the step S25), it is determined that paper of the A4 size is set widthwise, whereby the paper length and the paper width are stored in memory (in the steps S30 to S35). If the paper size code is not any of the above indicated numerals, it is determined that paper does not exist (in the step S26).

(d-3) Empty Display Control

Figure 11:
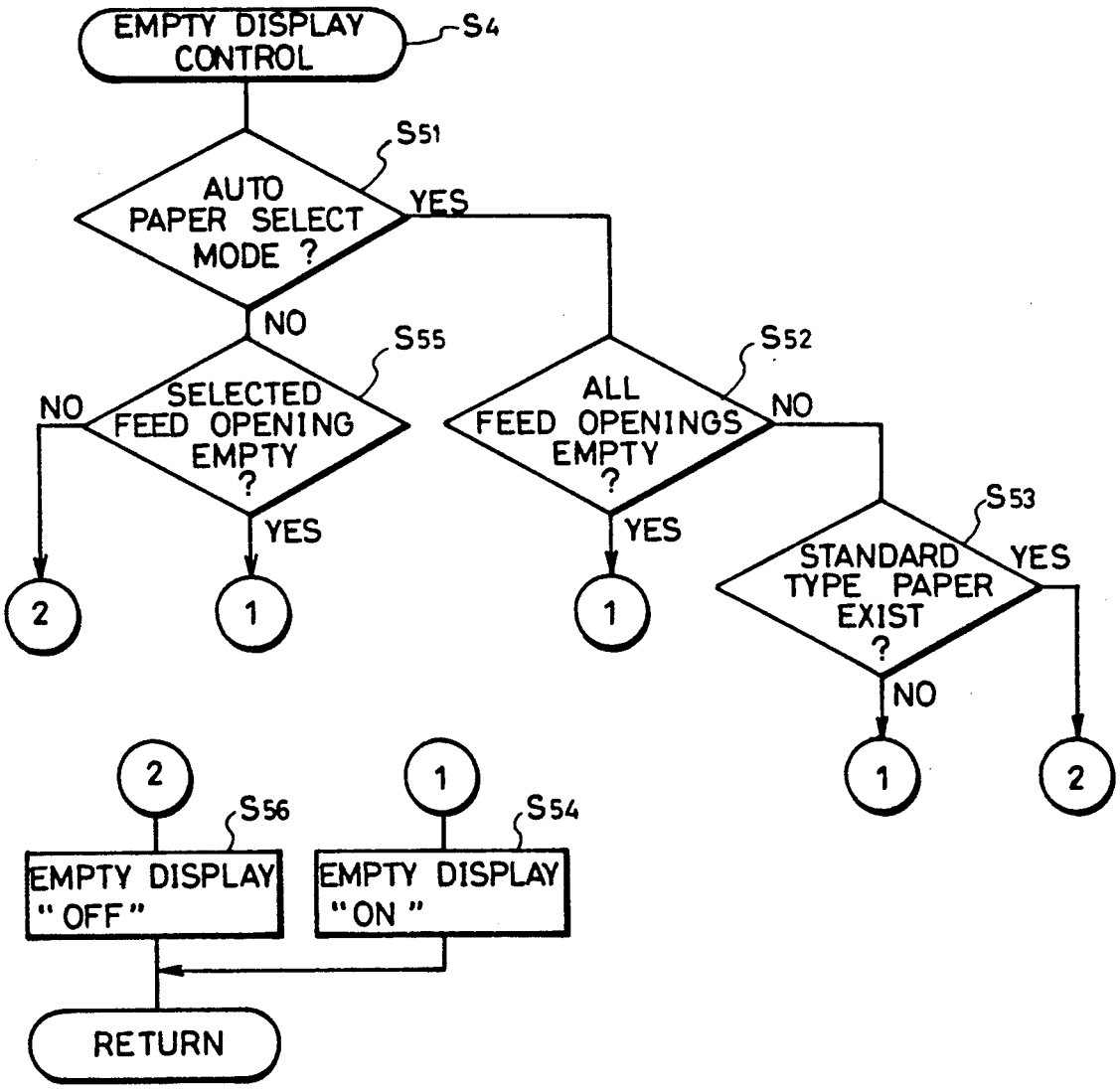
FIG. 11 is a flow chart of a subroutine of empty display control.

FIG. 11 is a flow chart of the subroutine of empty display control (in the step S4).

If the automatic paper selection mode is set (in the step S51), it is determined whether all the feed openings of the copying machine are empty (in the step S52). If they are all empty, the empty display is illuminated (in the step S54). If all of them are not empty, it is determined whether paper of a standard type. e.g., white copy paper is set in any feed opening or not (in the step S53). If the paper of the standard type does not exist in any of the feed openings, the empty display is illuminated (in the step S54). If paper of the standard type exists in any of the feed openings, the empty display is not illuminated (in the step S56). If the automatic paper selection mode is not set, the empty display is illuminated (in the step S54) if the selected feed opening is empty of paper (in the step S55), and the empty display is not illuminated (in the step S56) if the selected feed opening is not empty.

Although in this embodiment, the empty display is illuminated when sheets of paper of a non-standard type, e.g., color paper are set in all the feed openings in the automatic paper selection mode, the automatic paper selection mode may be cancelled in the step S53 if paper of the standard type does not exist in an of the feed openings by setting a size mismatch flag described below to "1" without illuminating the empty display.

(d-4) Copy Operation

Figure 12A:
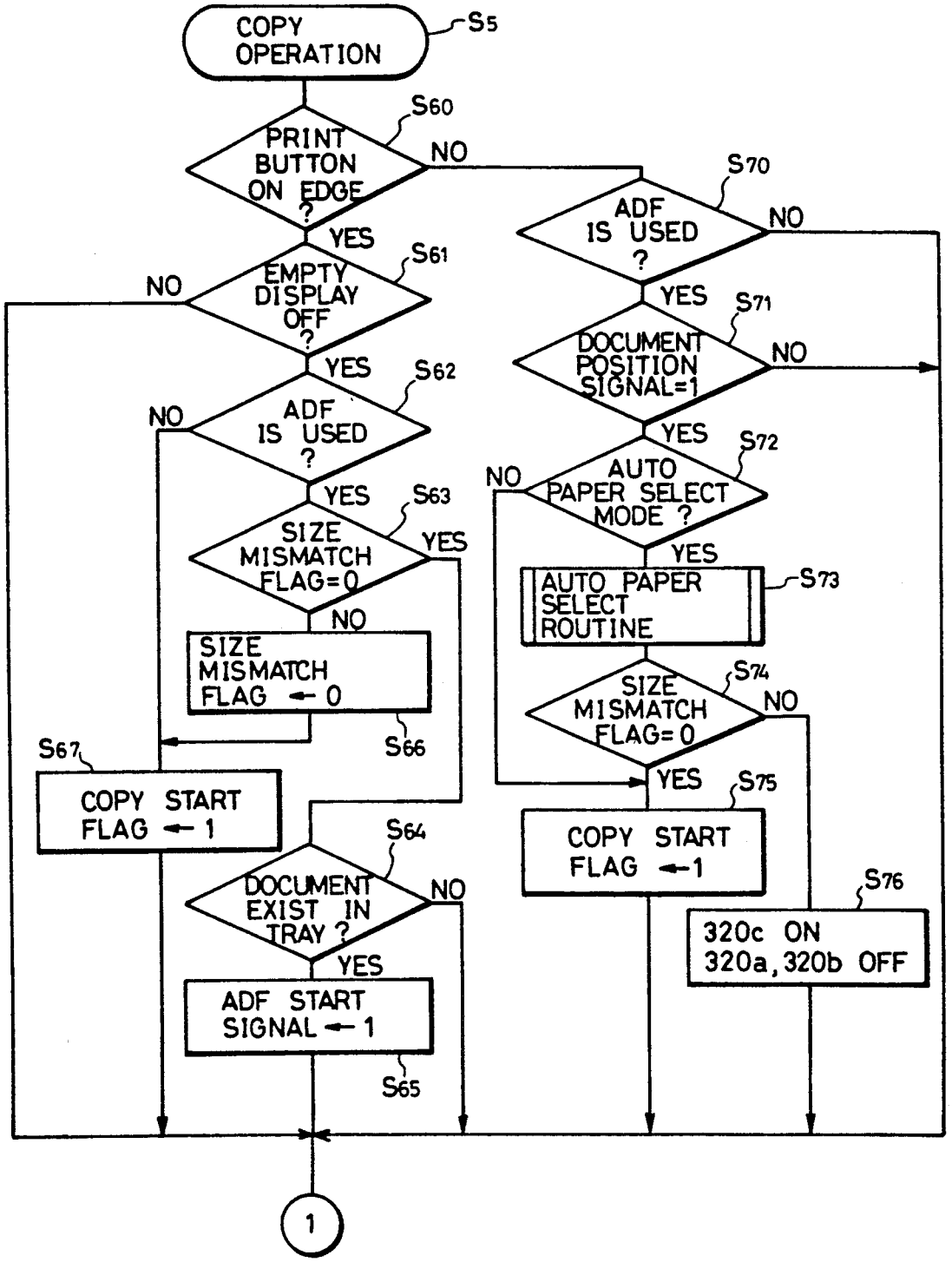
FIGS. 12A, 12B and 12C are flow charts of a subroutine of copy operation according to the present invention.
Figure 12B:
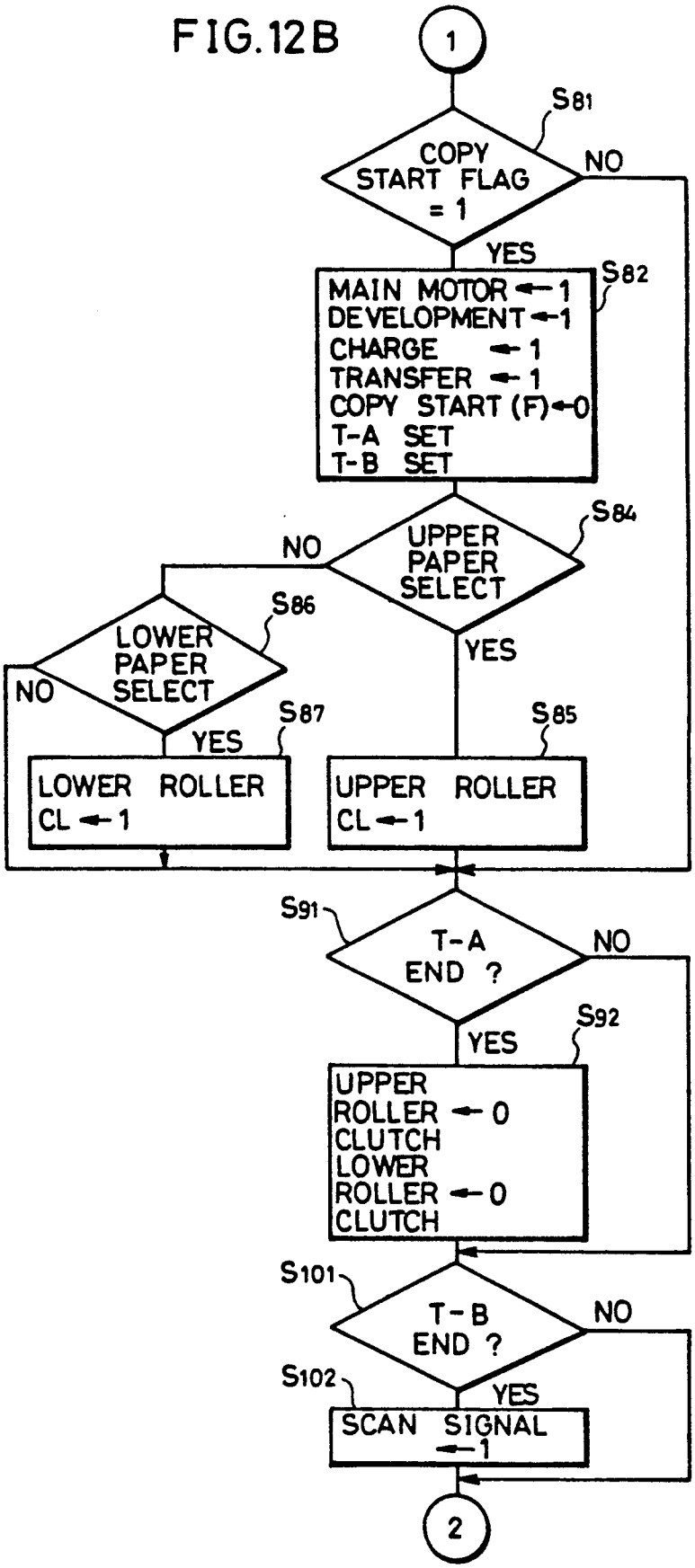
Figure 12C:
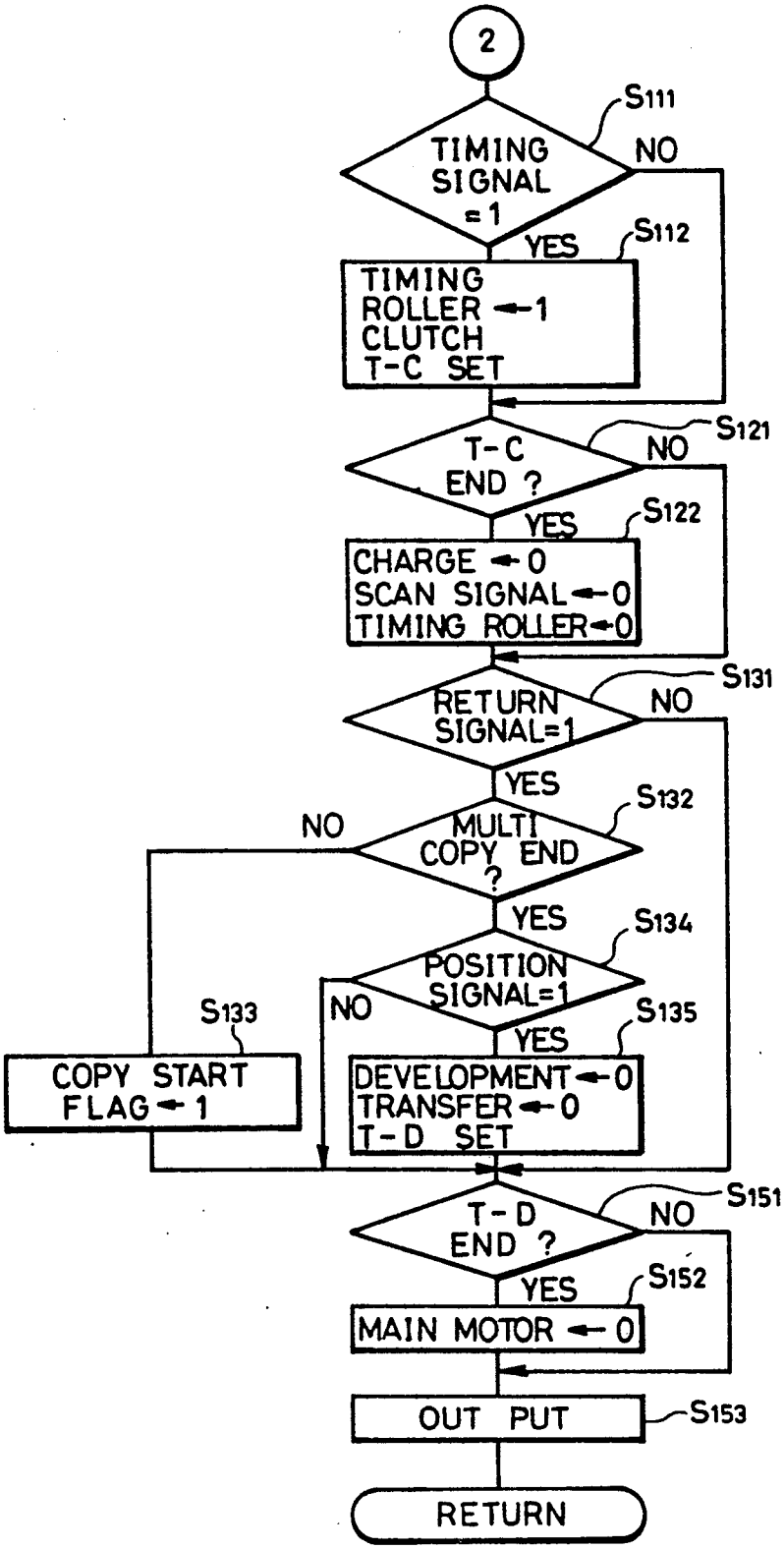

FIGS. 12A, 12B and 12C are flow charts of the copy operation routine S5.

At the ON edge of the print key 50 (in the step S60), if the empty display 52 is not illuminated (in the step S61) and if the automatic document feeder is not used (in the step S62), a copy start flag is set to "1" (in the step S67). If it is determined that the automatic document feeder is used (in the step S62), that a size mismatch flag is "0" (in the step S63) and that a document exists on the document tray 304 (in the step S64), an automatic document feeding start signal is set to "1" (in the step S65). On the other hand, if the empty display 52 is illuminated (in the step S61), the program directly proceeds to the subsequent routine.

With the timing not corresponding to the ON edge of the print key 50 (in the step S60), if the automatic document feeder is used (in the step S70), and if it is determined that the document position signal from the document feeding unit 300 is "1" (in the step S71) and that the mode of the automatic document feeder is the automatic paper selection mode (in the step S72), the automatic paper selection routine (in FIG. 13) is called (in the step S73). As a result, if the size mismatch flag is "0" (in the step S74), the copy start flag is set to "1" (in the step S75). If the size mismatch flag is "1", the display element 320*c* is illuminated and the display elements 320*a* and 320*b* are not illuminated. Then, the mode of the automatic document feeder is automatically changed to the manual mode (in the step S76). Since the manual mode is thus selected automatically, if one feels it troublesome to change paper, he may immediately press the print key 50 to start printing and, in such a case, a copy can be obtained although paper of the most suitable size is not used. More specifically, if, in this state, the ON edge of the print key 50 is detected (in the step S60) and it is determined that the empty display 52 is not illuminated (in the step S61), that the automatic document feeder is used (in the step S62) and that the size mismatch flag is not "0" (in the step S63), then the size mismatch flag is reset to "0" (in the step S66) and the copy start flag is set to "1" (in the step S67). In addition, if one wants to use paper of the most suitable size, he has only to manually set paper of the most suitable size.

The following copy operation is the same as in a conventional machine. When the copy start flag is "1" in the step S81, the main motor M1 and the development motor are turned on and the main and auxiliary chargers, the transfer charger etc. are also turned on. Then, the copy start flag is reset to "0" and the timers T-A and T-B are enabled to start measurement (in the step S82). If the upper paper feed cassette is selected (in the step S84), the upper feed roller clutch not shown is turned on (in the step S85). If the lower paper feed cassette is selected (in the step S86), the lower feed roller clutch not shown is turned on (in the step S87).

In the step S91, the state of the timer T-A is checked and when the timer T-A comes to an end, the upper and lower feed roller clutches are turned off (in the step S92).

In the step S101, the state of the timer T-B is checked. When the timer T-B comes to an end, a scanning signal is applied (in the step S102).

In the step S111, when the timing signal is "1", a timing roller clutch not shown is turned on and a timer T-C is enabled to start measuring (in the step S112).

In the step S121, when the timer T-C comes to an end, the scanning signal is stopped and the timing roller clutch as well as the main and auxiliary chargers is turned off (in the step S122).

In the step S131, when a return signal of the optical system is "1", namely, when return is started, it is determined (in the step S132) whether copy operation for a plural number of copies is completed or not. If it is not completed, the copy start flag is set to "1" (in the step S133). When the scanner which is temporarily moved away from the prescribed position returns to the prescribed position to cause the position sensor SW50 to be turned on (in the step S134), the development motor and the transfer charger are stopped and a timer T-D is enabled to start measurement (in the step S135).

When the timer T-D comes to an end (in the step S151), the main motor M1 is stopped (in the step S152). Subsequently, the results of the processing performed so far are outputted (in the step S153).

(d-5) Automatic Paper Selection

Figure 13:
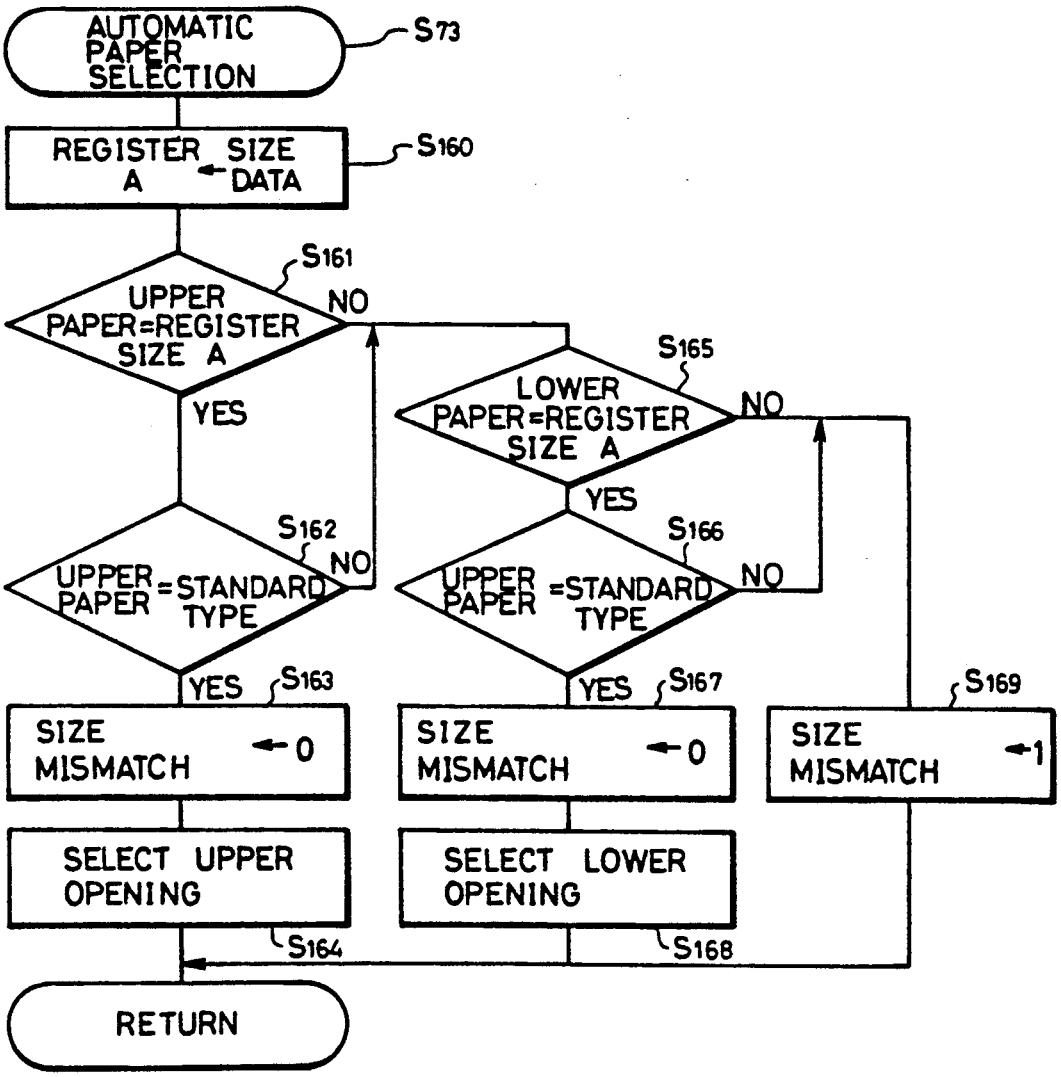
FIG. 13 is a flow chart of a subroutine of automatic paper selection.

FIG. 13 is a flow chart of the automatic paper selection routine S73. Document size data detected and transmitted by the microprocessor 203 controlling the document feeding unit 300 is temporarily stored in a register A in the microprocessor 201 (in the step S160).

Then, the document size data is compared with a paper size in the upper paper feed cassette 20 (in the step S161). If they are equal and the type of paper is the standard type (in the step S162), the size mismatch flag is reset to "0" (in the step S163) and the upper feed opening is selected (in the step S164). When the document size data is not equal to the paper size of cassette 20, the data is subsequently compared with a paper size in the lower paper feed cassette 21 (in the step S165). If they are equal and the type of paper is the standard type (in the step S166), the size mismatch flag is reset to "0" (in the step S167) and the lower feeding opening is selected (in the step S168). If the document size data is neither equal to the paper size in the first feed opening nor equal to that in the second feed opening, the size mismatch flag is set to "1" (in the step S169).

(e) Operation of the Automatic Document Feeder

Figure 14A:
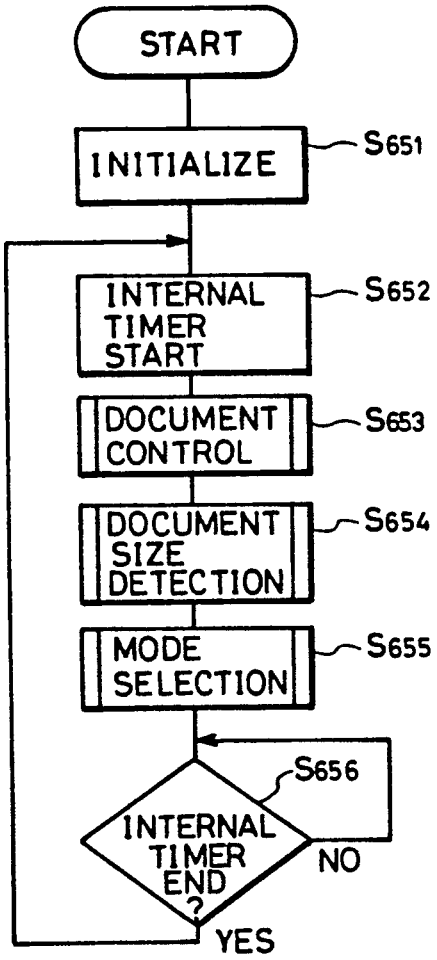
FIGS. 14A and 14B are flow charts of a main routine of a program of the microprocessor 203 for controlling the automatic document feeder.
Figure 14B:
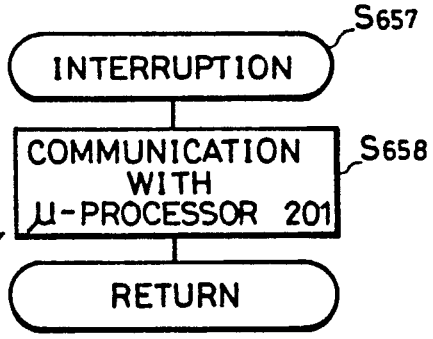

FIGS. 14A and 14B are flow charts of the main routine of the program in the microprocessor 203 for controlling the document feeding unit 300.

When the microprocessor 203 is reset to start the program, the microprocessor 203 is initialized to clear the RAM and to set the registers and the copying machine is set to the initial mode (in the step S651).

Then, the internal timer contained in the microprocessor 203 and having a value preset by the initialization is enabled to start operation (in the step S652).

Subsequently, a subroutine of document control (in the step S653), a subroutine of document size detection (in the step S654) and a subroutine of mode selection (in the step S655) are called successively. When all the procedures of the subroutines are completed, the program waits for an end of the initially set internal timer and then one routine is completed (in the step S656). Using the time period of one routine as a unit length, the timers in the subroutines perform counting operation. (A count value of each timer corresponds to the number of occurrences of one routine, by which an end of measurement of each timer is determined).

In addition, as shown in FIG. 14B, data communication (in the step S658) between the microprocessor 203 and the microprocessor 201 is conducted by an interruption routine based on a request for interruption (in the step S657) from the microprocessor 201, independent on the main routine.

Figure 15:
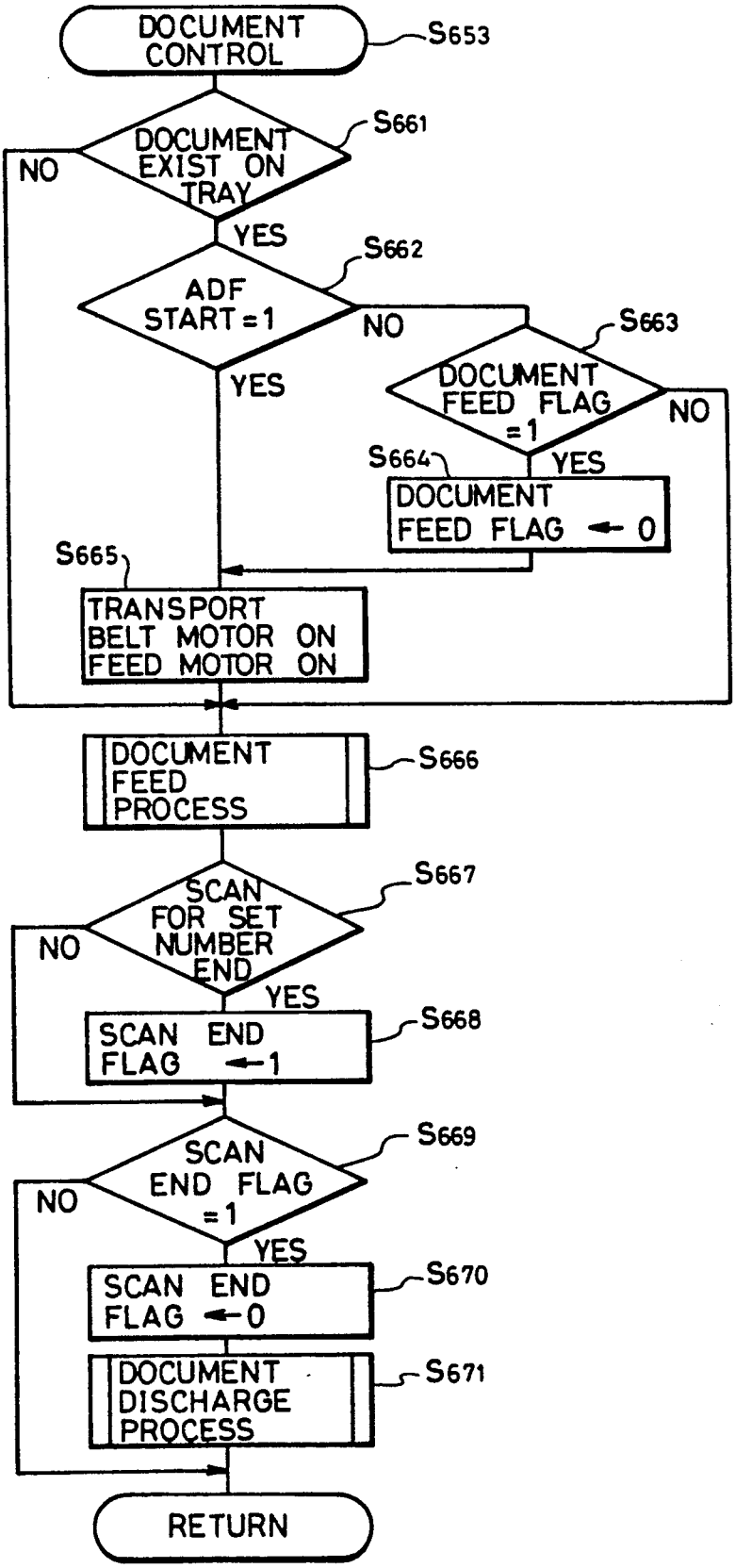
FIG. 15 is a flow chart of a subroutine of document control.

FIG. 15 is a flow chart of the document control subroutine S653. When a document exists on a document tray (that is, the document detection sensor 311 is turned on) (in the step S661), and when the automatic document feeding start signal from the microprocessor 201 is "1" (in the step S662), the transport belt motor 301 and the document feed motor 302 are turned on (in the step S665). On the other hand, when the document feed flag is "1" (in the step S663), the document feed flag is reset to "0" (in the step S664) and, after that, the transport belt motor 301 and the document feed motor 302 are turned on (in the step S665).

Then, processing in a document feeding process routine is performed (in the step S666). When scanning for the set number of sheets comes to an end (in the step S667), the scanning end flag is set to "1" (in the step S668).

When the scanning end flag is "1" (in the step S669), the scanning end flag is reset to "0" (in the step S670) and processing in the document discharge processing routine is performed (in the step S671).

Figure 16:
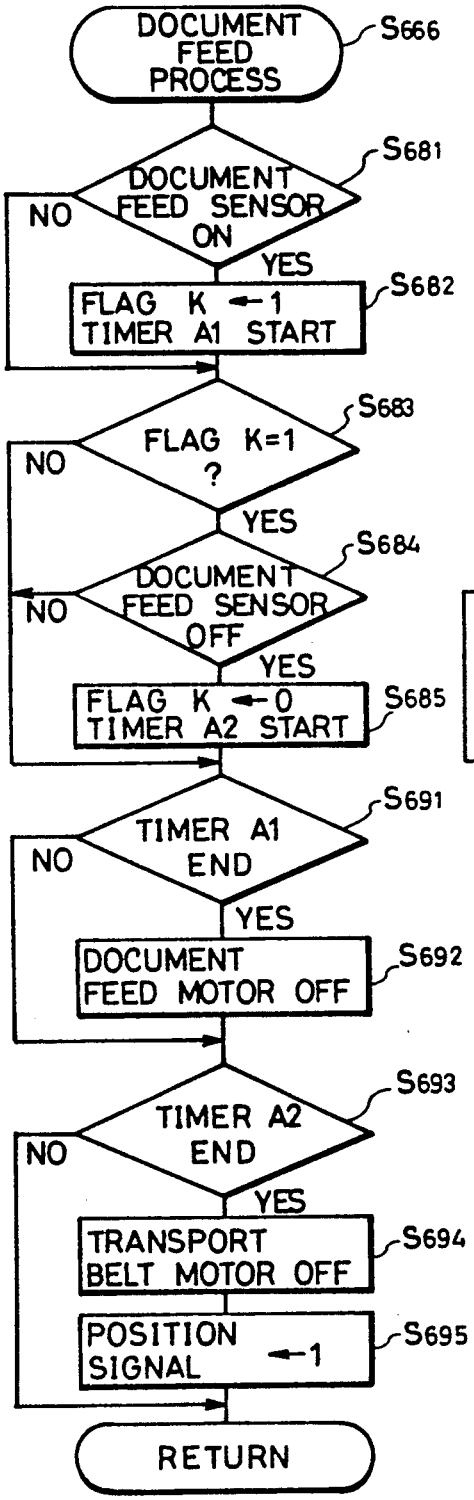
FIG. 16 is a flow chart of a subroutine of document feeding processing.

FIG. 16 is a flow chart of the document feed process routine S666. When a document is fed to turn on the document feed sensor 310 (in the step S681), a flag K is set to "1" and a timer A1 is enabled to start measurement (in the step S682). This timer A1 is used to stop the document feed motor 302 so that the subsequent document may not be fed after feeding of the document concerned. A value corresponding to a period required for a document to attain a position causing it to be driven by the transport belt 305 is set in this timer.

Then, when the flag K is "1" (in the step S683), and if an OFF edge of the document feed sensor 310 comes, that is, if a trailing edge of a document is detected (in the step S684), the flag K is reset to "0" and a timer A2 is enabled to start measurement (in the step S685). A set value of the timer A2 corresponds to a period required for the trailing edge of the document to attain a leading edge position on the document table of glass.

When the timer A1 comes to an end (in the step S691), the document feed motor 302 is stopped (in the step S692). When the timer A2 comes to an end (in the step S693), the transport belt motor 301 is stopped (in the step S694) and a document position signal is supplied to the microprocessor 201 (in the step S695).

Figure 17:
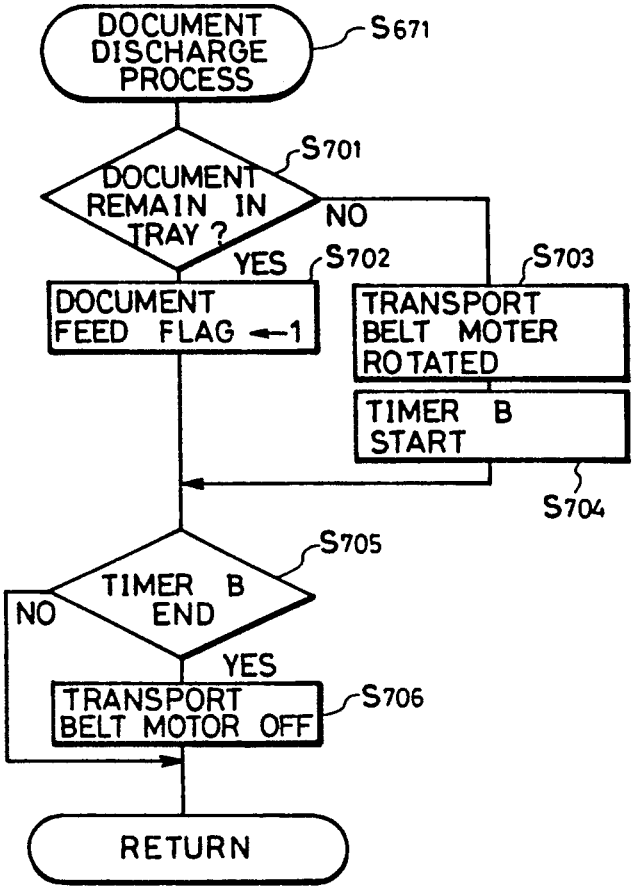
FIG. 17 is a flow chart of a subroutine of document discharge processing.

FIG. 17 is a flow chart of the document discharge processing routine S671. When it is determined by the document detection sensor 311 (in the step S701) that the subsequent document still remains on the document tray, the document feed flag is set to "1" (in the step S702). If the document does not exist on the document tray, the transport belt motor 305 is rotated in a forward direction (in the step S703) and a timer B is enabled to start measurement (in the step S704). A set value of the timer B corresponds to a period required for the document (having the largest length) on the document table to be removed therefrom. When the timer B comes to an end (in the step S705), the transport belt motor 301 is turned off (in the step S706).

Figure 18:
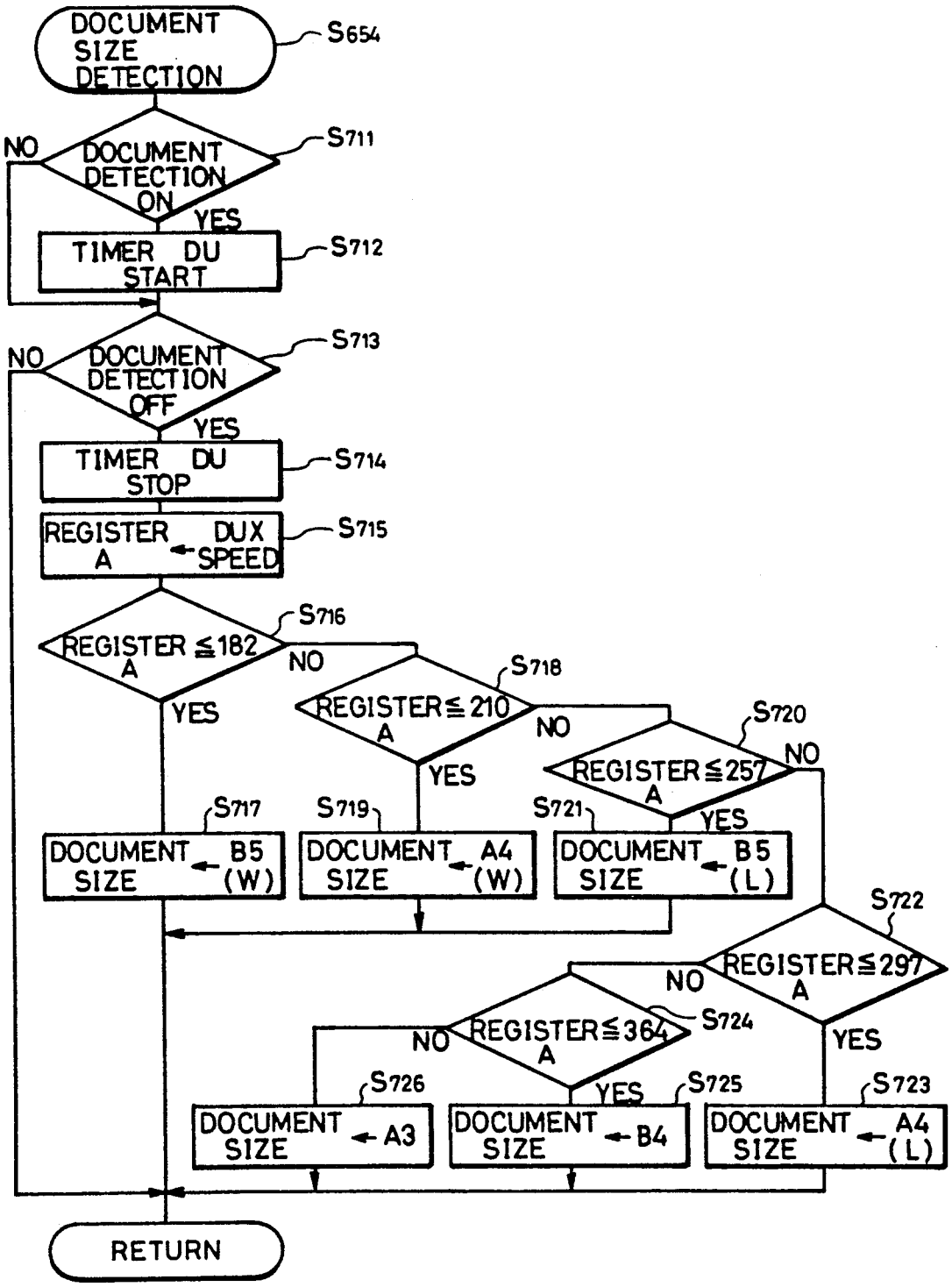
FIG. 18 is a flow chart of a subroutine of document size detection.

FIG. 18 is a flow chart of the document size detection routine S654. At an ON edge of the document detection sensor 311 (in the step S711), a timer DU is enabled to start measurement (in the step S712). Then, at an OFF edge of the document detection sensor 311, namely, at the trailing edge of the document (in the step S713), the timer DU is stopped (in the step S714) and a product obtained by multiplication of the value of the timer DU at that time by the document transport speed, namely, the length of the document, is stored in the register A (in the step S715). If the value of the register A is 182 mm or less (in the step S716), it is determined that the document size is B5 widthwise (in the step S717). If it is 210 mm or less (in the step S718), it is determined that the document size is A4 widthwise (in the step S719). If it is 257 mm or less (in the step S720), it is determined that the document size is B5 lengthwise (in the step S721 . If it is 297 mm or less (in the step S722), it is determined that the document size is A4 lengthwise (in the step S723). If it is 364 mm or less (in the step S724), it is determined that the document size is B4 (in the step S725). If it exceeds 364 mm, it is determined that the document size is A3 (in the step S726).

In order to precisely determine the document size, another sensor for determination of a document width may be provided adjacent to the sensor 310 so that turning on and off of the sensor may serve to determine sizes having different width values with the same length value (for example, A4 widthwise, A5 lengthwise etc.).

Figure 19:
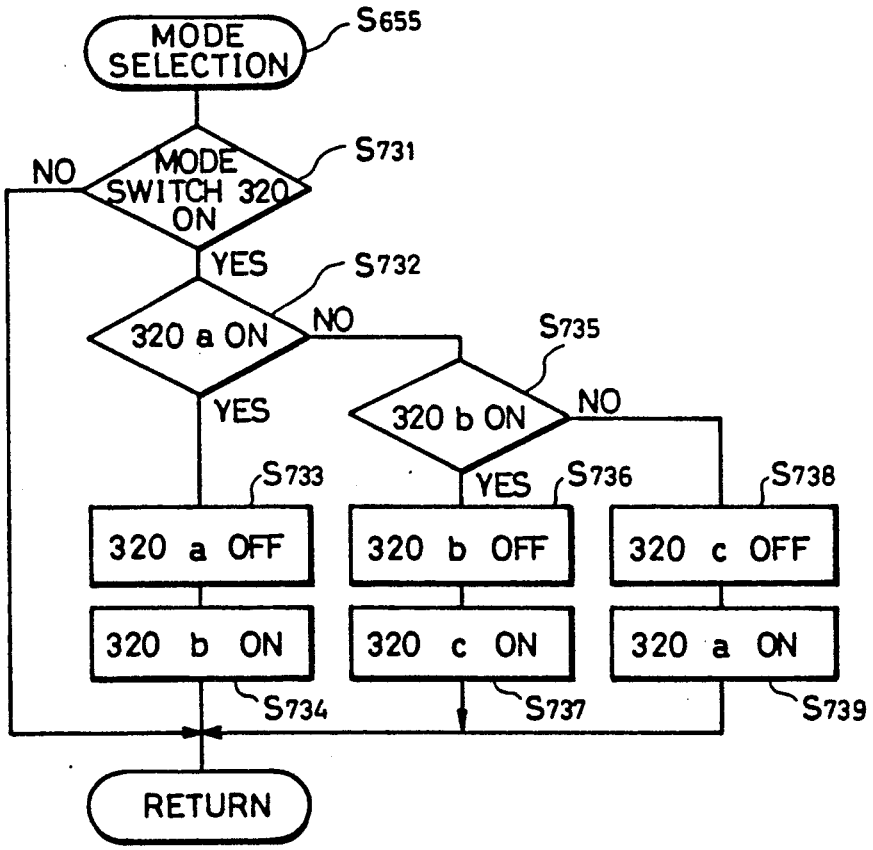
FIG. 19 is a flow chart of a subroutine of mode selection.

FIG. 19 is a flow chart of the mode selection routine (in the step S655). When the mode selection switch 320 is turned on (in step S731), mode selection is performed in the following manner. If the LED display element 320*a* is illuminated at the ON edge of the switch 320 (in the step S732), which means that the automatic paper selection mode is selected, the mode is changed to the automatic magnification selection mode (in the steps S733 and S734); if the LED display element 320*b* is illuminated at the ON edge (in the step S735), which mean that the automatic magnification selection mode is selected, the mode is changed to the manual mode (in the step S736 and S737); and in the other cases, the mode is changed to the automatic paper selection mode (in the steps S738 and S739).

Although in the above described embodiment, paper of the standard type is white paper, it is not limited thereto. For example, for the users using red copy paper most frequently, red paper may be set as paper of the standard type. In addition, a standard paper selection switch may be provided so that the user can freely change paper of the standard type.

In addition, although the automatic paper selection function in the above described embodiment is performed to automatically select a feed opening containing copy paper of a size corresponding to a detected document size, the automatic paper selection function is not limited thereto. For example, the function may be performed to select a feed opening containing copy paper of a size corresponding to a copy image size determined based on a detected document size and an input copying magnification.

As described in the foregoing, according to the present invention, copy operation is not started when paper of the standard type does not exist in any of the feed openings in the automatic paper selection mode even if paper of other type exists in a selected feed opening. Thus, the automatic paper selection function can be performed more effectively and efficiency in copy operation is further improved.

Although the present invention has been described and illustrated in detail, it is clearly understood that the sane is by way of illustration and example only and is not to be taken by way of limitation, the spirit and scope of the present invention being limited only by the terms of the appended claims.

What is claimed is:

1. A copying machine comprising:

image forming means for forming an image of an original on copy paper;

a plurality of paper feed means for storing sheets of copy paper of different sizes and feeding the same therefrom one by one to said image forming means;

original detection means for detecting the size of the original to be copied;

copy paper size detection means for detecting the size of copy paper stored in each of said paper feed means;

copy paper type detector means for detecting the type of copy paper stored in each of said paper feed means;

automatic selection means for automatically selecting the paper feed means storing copy paper of the same size as that of the original; and forbidding means responsive to said copy paper type detector means for forbidding operation of said automatic selection means and said original detection means when copy paper of a predetermined type is not stored in any of said paper feed means.

2. A copy machine in accordance with claim 1, wherein said copy paper type detector means detects the color of the copy paper stored in each of said paper feed means; and said forbidding means forbids operation of said automatic selection means and said original detection means when white copy paper is not stored in any of said paper feed means.

3. A copy machine in accordance with claim 1, further comprising means for detecting existence or nonexistence of copy paper in each of said paper feed means; and said forbidding means further forbids operation of said automatic selection means when copy paper is not stored in any of said paper feed means.

4. A copying machine in accordance with claim 1, further comprising;

display means for indicating that copy paper of said predetermined type is not stored in any of said paper feed means.

5. A copying machine comprising:

an image forming device which forms an image of an original on copy paper;

a plurality of paper feeders each of which stores sheets of copy paper and feeds the same therefrom one by one to said image forming device;

an original detector which detects a size of the original to be copied;

a paper size detector which detects the size of copy paper stored in each of said paper feeders;

a paper type detector which detects the type of copy paper stored in each of said paper feeders;

an automatic selector which automatically selects the paper feeder storing copy paper of the same size as that of the original; and a controller responsive to said paper type detector which forbids operation of said automatic selector and said original detector when copy paper of a predetermined type is not stored in any of said paper feed means.

6. A copying machine comprising:

image forming means for forming an image of an original on copy paper;

a plurality of paper feed means each storing sheets of copy paper for feeding the same therefrom one by one to said image forming means;

original detection means for detecting a size of the original to be copied;

copy paper size detection means for detecting the size of copy paper stored in each of said paper feed means;

a copy paper type detector means for detecting the type of copy paper stored in each of said paper feed means;

manual selection means for manually selecting one of said plurality of paper feed means;

automatic selection means for automatically selecting the paper feed means storing copy paper of the same size as that of the original in an automatic mode;

mode selection means for selecting the automatic mode;

cancel means responsive to said copy paper type detector means for canceling the selection of the automatic mode and the operation of the original detection means when copy paper of a predetermined type is not stored in any of said paper feed means.

7. A copying machine comprising:

an image forming device which forms an image of an original on a copy paper;

a plurality of paper feeders each of which stores sheets of copy paper and feeds the same one by one to said image forming device;

an original detector which detects a size of the original to be copied;

a copy paper size detector which detects the size of copy paper stored in each of said paper feeders;

a copy paper type detector which detects the type of copy paper stored in each of said paper feeders;

a manual selector which manually selects one of said plurality of paper feeders;

an automatic selector which automatically selects the paper feeder storing copy paper of the same size as that of the original in an automatic mode;

a mode selector which selects the automatic mode; and a controller responsive to said copy paper type detector which cancels the selection of the automatic mode and the operation of the original detector when copy paper of a specified type is not stored in any of said paper feeders.

8. A copying machine in accordance with claim 7, wherein:

said copy paper type detector detects the color of the copy paper stored in each of said paper feed means; and said controller cancels the selection of the automatic mode and the operation of the original detector when white copy paper is not stored in any of said paper feed means.

9. A copying machine comprising:

image forming means for forming an image of an original on a copy paper;

a plurality of paper feed means, each storing sheets of copy paper, for feeding the same therefrom one by one to said image forming means;

original detection means for detecting the size of the original to be copied;

copy paper size detection means for detecting the size of copy paper stored in each of said paper feed means;

a copy paper type detector means for detecting the type of copy paper stored in each of said paper feed means;

manual selection means for manually selecting one of said plurality of paper feed means;

automatic selection means for automatically selecting the paper feed means storing copy paper of the same size as that of the original in an automatic mode;

mode selection means for selecting the automatic mode;

display means responsive to said paper type detector means for illuminating an empty display in response to the selection of said automatic mode when copy paper of a predetermined type is not stored in any of said paper feed means; and forbidding means for forbidding the operation of the original detection means when said empty display is illuminated.

10. A copying machine comprising:

image forming means for forming an image of an original on copy paper;

a plurality of paper feed means for storing sheets of copy paper of different sizes and feeding the same therefrom one by one to said image forming means;

automatic selection means operatively connected to original detection means for detecting the size of the original to be copied, copy paper size detection means for detecting the size of copy paper stored in each of said paper feed means and copy paper type detector means for detecting the type of copy paper stored in each of said paper feed means, said automatic selection means automatically selecting the paper feed means storing copy paper of the same size as that of the original;

input means having a manual operable switch member and for inputting a start command in response to the operation of said switch member;

control means for initiating said automatic selection means and said image forming means; and forbidding means responsive to said copy paper type detector means for forbidding operation of said control means and said original detection means when copy paper of a predetermined type is not stored in any of said paper feed means.

11. A copying machine in accordance with claim 10 wherein;

said copy paper type detector means detects the color of the copy paper stored in each of said paper feed means; and said forbidding means forbids the operation of said control means and said original detection means when white copy paper is not stored in any of said paper feed means.

12. A copy machine in accordance with claim 1, wherein said copy paper type detector means comprises:

two reed switches provided facing a side face of said paper feed means;

a guide plate connected to the side face so as to form a space between the side face and said guide plate, said guide plate comprising a window;

an indication plate slideably inserted in the space between side guide plate and the side face, said indication plate having a magnet near a first end and color indicating means near a second end for selecting a color of copy paper stored in said paper feed means, whereby the position of said magnet with respect to said reed switches is changed for each color and a color signal is obtained by combination of on/off states of said reed switches.

13. A copy machine in accordance with claim 1, wherein said copy paper type detector means comprises means associated with said paper feed means for indicating the type of copy paper stored therein.

14. A copy machine in accordance with claim 1, wherein said image forming means includes means for transporting the original onto a platen, said forbidding means further forbidding operation of said original transporting means.

15. A copying machine in accordance with claim 1, further comprising:

inputting means for inputting a signal for starting to operate said image forming means; and canceling means responsive to said copy paper type detection means for canceling said signal when copy paper of a predetermined type is not contained in the said paper feeding means selected by said automatic selection means.

16. A copying machine comprising:

image forming means for forming an image of an original on copy paper;

a plurality of paper feed means for storing sheets of copy paper of different sizes and feeding the same therefrom one by one to said image forming means;

copy paper type detection means for detecting the type of copy paper stored in each of said paper feed means;

automatic document feeding means for feeding a document to be copied from a loading tray to a position proximate the image forming means; and forbidding means responsive to said copy paper type detector means for forbidding operation of said automatic document feeding means when copy paper of a predetermined type is not stored in any of said paper feed means.

17. A copy machine comprising:

image forming means for forming an image of an original on copy paper in a copy mode;

a plurality of paper feed means for storing sheets of copy paper of different sizes and feeding the same therefrom one by one to said image forming means;

original detection means for detecting the size of the original to be copied;

copy paper size detection means for detecting the size of copy paper stored in each of said paper feed means;

copy paper type detector means for detecting the type of copy paper stored in each of said paper feed means;

automatic selection means for automatically selecting the paper feed means storing copy paper of the same size as that of the original; and canceling means responsive to said copy paper type detection means for canceling the selection of the copy mode and the operation of the original detection means when copy paper of a predetermined type is not stored in the paper feed means selected by the automatic selection means.

* * * * *